United States Patent [19]

Baker et al.

[11] Patent Number: 4,677,918

[45] Date of Patent: Jul. 7, 1987

[54] RAILROAD CAR WITH RETRACTABLE CLOSURE TRACK HELD DOWN BY BRIDGE PLATE

[75] Inventors: William R. Baker, Lawrenceville; Walter J. Marulic, Dunwoody; James C. Robertson, Lawrenceville, all of Ga.

[73] Assignee: Thrall Car Manufacturing Company, Chicago Heights, Ill.

[21] Appl. No.: 768,805

[22] Filed: Aug. 23, 1985

[51] Int. Cl.[4] ..... E05D 13/00; A47H 17/06; B61D 19/00

[52] U.S. Cl. ..... 105/378; 49/404; 280/403; 16/96 R

[58] Field of Search ..... 410/26, 27; 105/378, 105/436, 458, 459; 14/69.5, 71.1; 49/404, 372, 409–411; 414/537; 280/403; 16/90, 91, 96 R; 160/196, 196 D, 199, 201, 206, 214

[56] References Cited

U.S. PATENT DOCUMENTS

| | | | |
|---|---|---|---|
| 1,750,989 | 3/1930 | Bradfield | 160/199 |
| 2,690,141 | 9/1954 | King | 410/26 |
| 3,683,451 | 8/1972 | Tanner | 49/410 X |
| 3,701,179 | 10/1972 | Cox | 16/90 |
| 3,756,302 | 9/1973 | Sivin | 160/196 X |
| 4,077,330 | 3/1978 | Peisner et al. | 410/26 X |
| 4,084,516 | 4/1978 | Ravani et al. | 410/26 |
| 4,116,135 | 9/1978 | Jaekle et al. | 410/26 |
| 4,437,410 | 3/1984 | Stoller, Sr. et al. | 160/196 D X |
| 4,598,499 | 7/1986 | Viner | 49/411 |

FOREIGN PATENT DOCUMENTS

| | | | |
|---|---|---|---|
| 156972 | 6/1978 | Netherlands | 105/378 |
| 0588007 | 5/1977 | Switzerland | 49/410 |
| 2104021 | 3/1983 | United Kingdom | 105/378 |

*Primary Examiner*—Robert B. Reeves
*Assistant Examiner*—Scott H. Werny
*Attorney, Agent, or Firm*—Marshall, O'Toole, Gerstein, Murray & Bicknell

[57] ABSTRACT

A railroad car for transporting vehicles such as automobiles and trucks has a pair of door assemblies which close each end of the railroad car. The lower end of the door assemblies are guided in a track and the track has vertically retractable sections located where the vehicle tires roll so as to provide added load height when the car ends are open and vehicles are being loaded or unloaded. An embodiment with a pivotal, counterweighted Z-shaped member upon which the retractable track section is mounted is disclosed along with an embodiment utilizing a vertically displaceable tubular member and a coil spring.

16 Claims, 13 Drawing Figures

RAILROAD CAR WITH RETRACTABLE CLOSURE TRACK HELD DOWN BY BRIDGE PLATE

This invention relates to railroad cars used to transport vehicles such as automobiles and trucks, and which are generally referred to as auto rack cars. More particularly, this invention is concerned with an improved end closure or door guide track to facilitate unloading vehicles from such cars.

BACKGROUND OF THE INVENTION

Railroad cars are widely used in the United States and other countries to transport vehicles such as automobiles and trucks from manufacturing plants to distribution centers. Such railroad cars are referred to in the trade as auto rack cars.

The railroad cars include a floor and a pair of side walls which, if desired, support at least one, and often two, elevated decks. Additionally, a roof is generally included to protect the vehicles against damage. The floor, and any decks present, carry lined-up vehicles.

It is customary to load, and for railroads to move, a number of such railroad cars in groups hitched together end-to-end and after arrival at a distribution center for the group of railroad cars to be loaded simultaneously. When a group of railroad cars is loaded simultaneously, the vehicles enter at one end and are driven forward as far as possible to a tie down position on one of the railroad cars. This is called circus loading. To make such loading possible the distance between adjoining railroad car ends must be spanned by removable bridge plates at the car floor level and at each deck level. The bridge plates support the vehicle wheels as the vehicles roll from one railroad car to the next.

Vehicles are unloaded from the group of railroad cars in a similar manner, referred to as circus unloading. Vehicles are driven forward from one railroad car to the next over bridge plates and ultimately down ramps, at the forward end of the front car, to the ground.

Stoller et al U.S. Pat. No. 4,437,410 discloses an auto rack railroad car with a closure at each end to prevent vandalism and thievery. Each closure comprises two door assemblies which move horizontally to open and close the car end. The door assemblies are movably supported by a horizontal support member mounted in the interior of the car at the front end or edge of the uppermost of two elevated decks.

Because the door assemblies have a substantial height the bottom of the doors are slidably secured against lateral movement by use of a track or rail, mounted on the railroad car floor, which is engaged by guide means attached at the bottom of the door assemblies. The track or rail has a front run lateral to the car and a run along each side of the car. The entire track guides the door assemblies when the railroad car end is opened and closed by slidable movement of the doors.

Although the guide track for the door assemblies functions satisfactorily as a door guide, it constitutes a ridge which extends upwards about two inches above the floor and reduces the available loading space. Also, when vehicle wheels hit the track, the vehicles bounce. The bouncing can cause the vehicle roof to hit a deck, if present, above it. Also, it can make it difficult for a driver to control the vehicle being unloaded. There is thus a need for an improved guide track which does not interfere with vehicle unloading but which is still able to slidably secure door assemblies in place when in closed position.

SUMMARY OF THE INVENTION

According to the invention there is provided a railroad car for transporting vehicles, such as automobiles and trucks, comprising a floor and two side walls defining an interior space and terminating in an opening at each end; an end closure at each end of the car adapted to be displaced between a closed position overlying the end opening and an opened position which provides access to the entire end of the car; an elongated closure support member at each end of the car disposed within the car interior in a horizontal plane; the closure support member having a front run lateral to the car and a side run along each car side wall; the closure comprising a pair of door assemblies; each door assembly having a forward vertical end and a rear vertical end; means vertically suspending the door assemblies from the closure support member so that the door assemblies are movable horizontally toward each other into closed position to close the car end with the forward ends of the door assemblies in abutting position to each other in the middle of the closure support member front run, and away from each other into open position with each door assembly supported on a closure support member side run; a guide track, for the door assemblies, disposed within the car interior in a horizontal plane and mounted to the car floor and extending upwardly therefrom; the guide track having a front run lateral to the car and a side run along each car side wall; guide means carried by the bottom of the door assemblies engaging the guide track to guide the door assemblies along the track when they are moved to open and close the car end; the guide track front run having two spaced apart retractable track sections movable up and down for substantially the height of the track; and the retractable track sections being positioned to be centered with respect to the tread and tire widths of vehicles transported by the railroad car.

Means is desirably included to forcibly maintain the retractable track sections in up position when the door assemblies are closed. A spring can be used for this purpose. However, a counterweighted lever can also be used to keep the track in up position.

Locking means may also be added to prevent the track sections from moving down and out of engagement with the guide means carried by the bottom of the door assemblies when the door assemblies are closed. Such a locking means prevents the door assemblies from being pried apart and removed or bent and thereby reduces unlawful entry of the railroad car. However, it is desirable that the locking means be open when the door assembly guide means is out of engagement with the cooperating track section.

Locking means can also be provided to prevent the door assemblies from being moved into closed position when the track sections are not raised and in position to be engaged by the guide means at the bottom of the door assemblies.

To assure that the track sections are in down position when vehicles are to be loaded on, or unloaded from, the railroad car it is desirable to mount bridge plate support means on the car adjoining each retractable track section; and to include means which maintains a track section in down position when a bridge plate is engaged with the adjoining bridge plate support means.

The bridge plate support means can be a pair of spaced apart horizontal stub tubes adapted to receive retaining pins from a bridge plate.

DETAILED DESCRIPTION OF THE DRAWINGS

To the extent it is reasonable and practical the same or similar elements appearing in the various views of the drawings will be identified by the same numbers.

Figure 1:
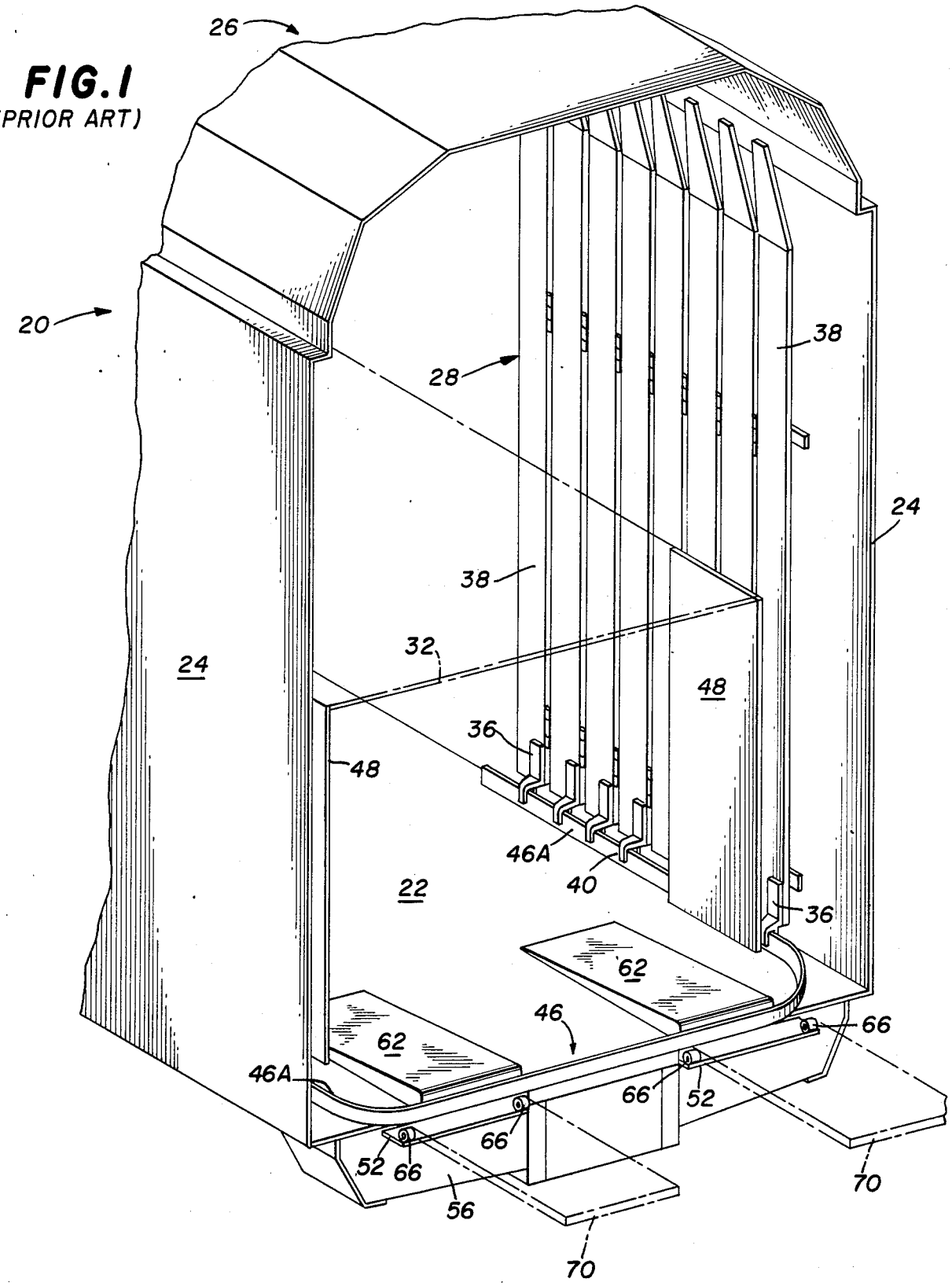
FIG. 1 (PRIOR ART)
FIG. 1 is an isometric stylized view of the end of a prior art railroad car of the type disclosed in U.S. Pat. No. 4,437,410 for carrying vehicles such as automobiles and trucks on two or three levels.

With reference to FIG. 1, the railroad car 20 shown in this drawing is a commercial embodiment of the car shown in U.S. Pat. No. 4,437,410. The car 20 has a floor 22 supported by an end sill 56 and a center sill, side sill and cross bearers, not shown. Side walls 24 extend up from the floor 22 and support roof 26.

The car end is provided with a pair of door assemblies 28 which are essentially mirror images of each other. FIG. 1 shows, in stowed position, only one of the door assemblies 28. The second door would be stowed in a similar manner when the car end is fully open to load or unload vehicles.

Vehicles are intended to be carried on floor 22 and deck 32.

Figure 7:
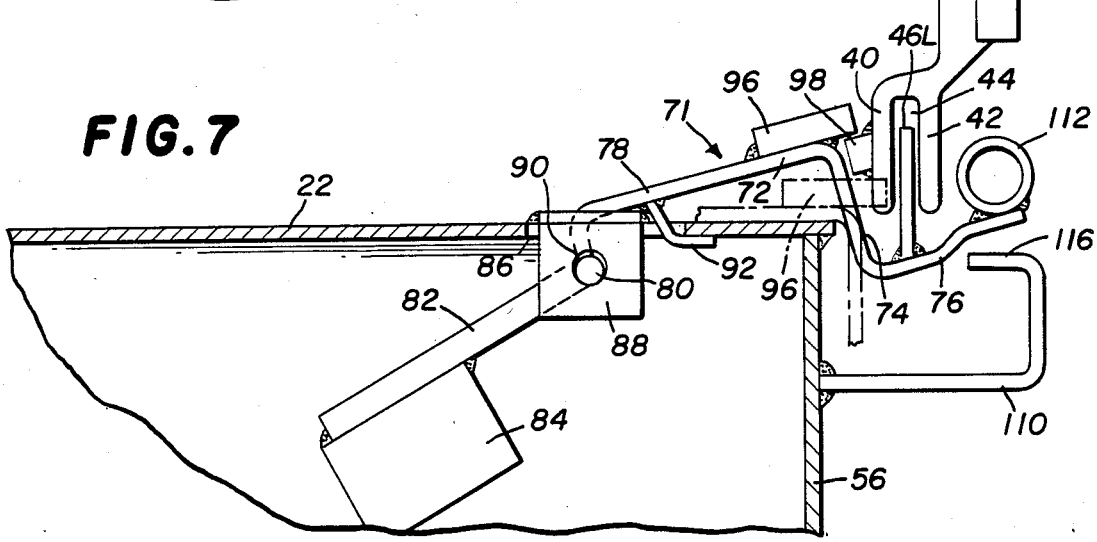
FIG. 7 is similar to FIG. 6 but it shows the retractable track section in raised or up position with a car door assembly engaging and locking the track section in raised position.
Figure 8:
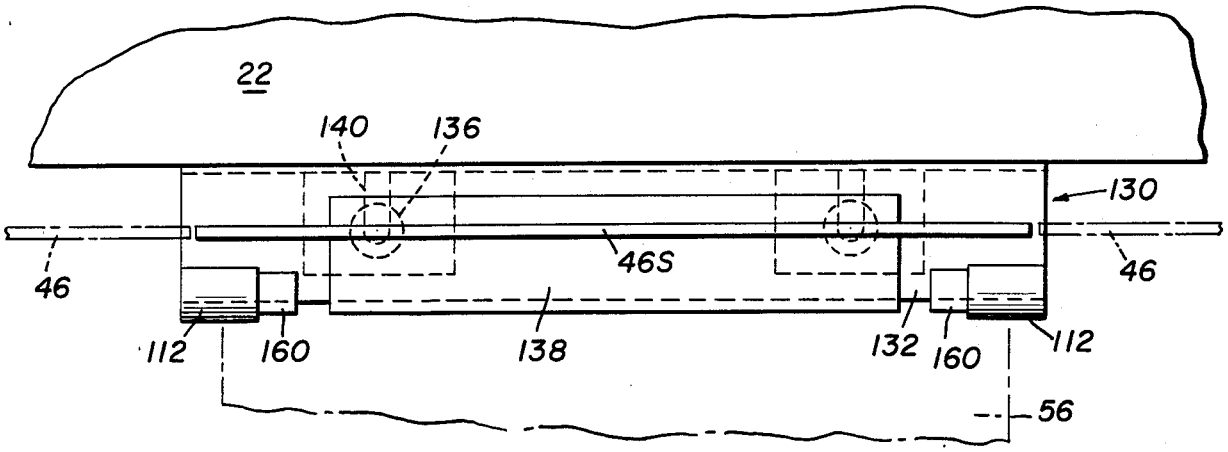
FIG. 8 is a plan view of the end portion of a car floor showing a second embodiment of the invention having a spring loaded retractable track section for a car door assembly.
Figure 9:
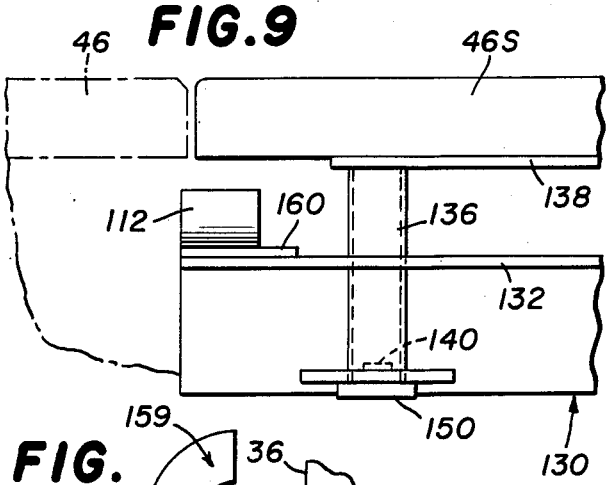
FIG. 9 is an elevational view of the track section shown in FIG. 8 in an up or raised position.
Figure 10:
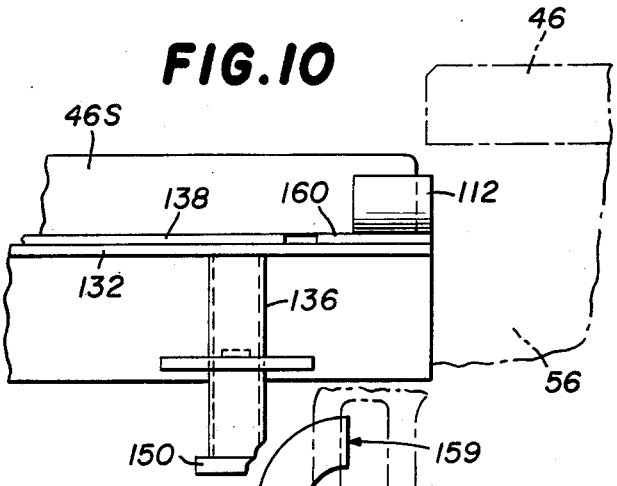
FIG. 10 is an elevational view, similar to FIG. 9, but with the track section shown in a down or retracted position.
Figure 11:
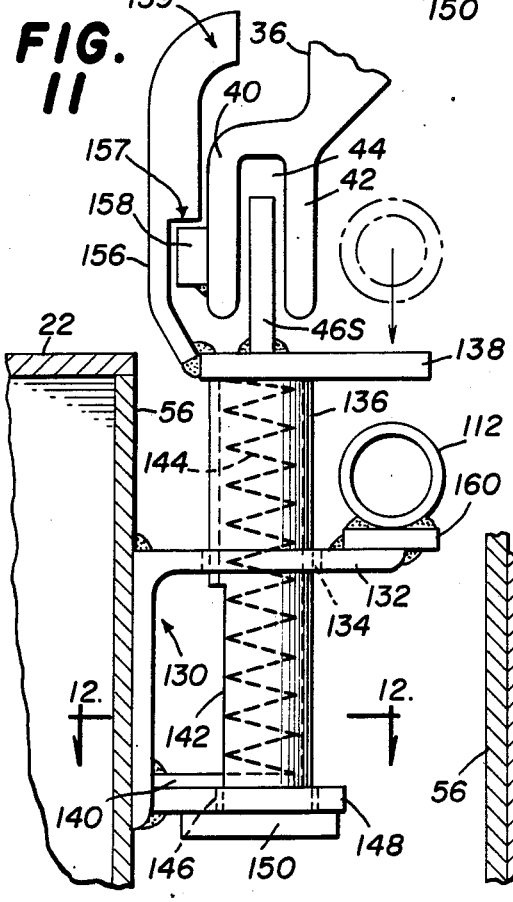
FIG. 11 is a side elevational view of the second embodiment as shown in FIG. 9 with the track section in raised or up position and with a car door assembly engaging and locking the track section in raised position.
Figure 12:
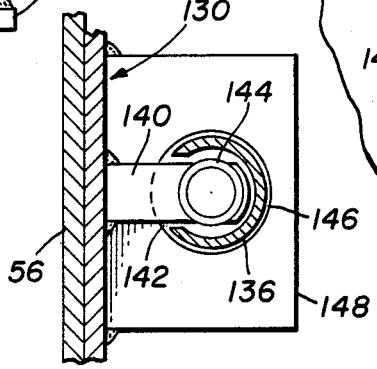
FIG. 12 is a sectional view taken along the line 12—12 of FIG. 11.

Each of the door assemblies 28 is rollably suspended from a track located along the front and sides of deck 32. The lower ends of the door assemblies are provided with guide members 36 attached to the lower inner sides of panels 38. Each member 36 has a pair of spaced apart vertical legs 40,42 which define a groove 44 in which guide track or rail 46 fits loosely (FIGS. 1, 7 and 11).

The track 46, in plan view, is U-shaped and the legs 46A of the U are disposed within the space between car side walls 24 and deck vertical support plates 48 extending from the car floor 22 to deck 32.

Figure 2:
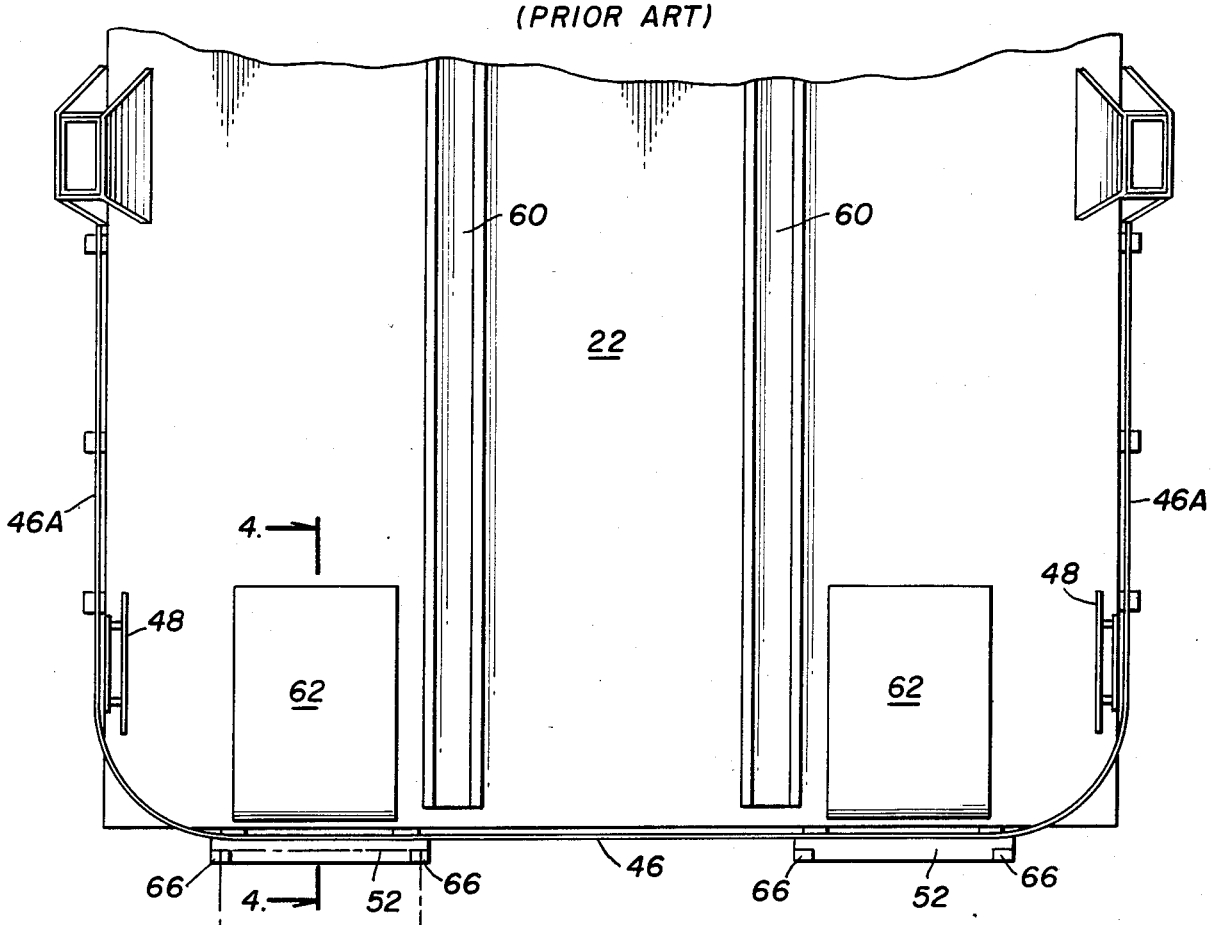
FIG. 2 (PRIOR ART)
FIG. 2 is a plan view of the end portion of the floor of the car shown in FIG. 1.
Figure 3:
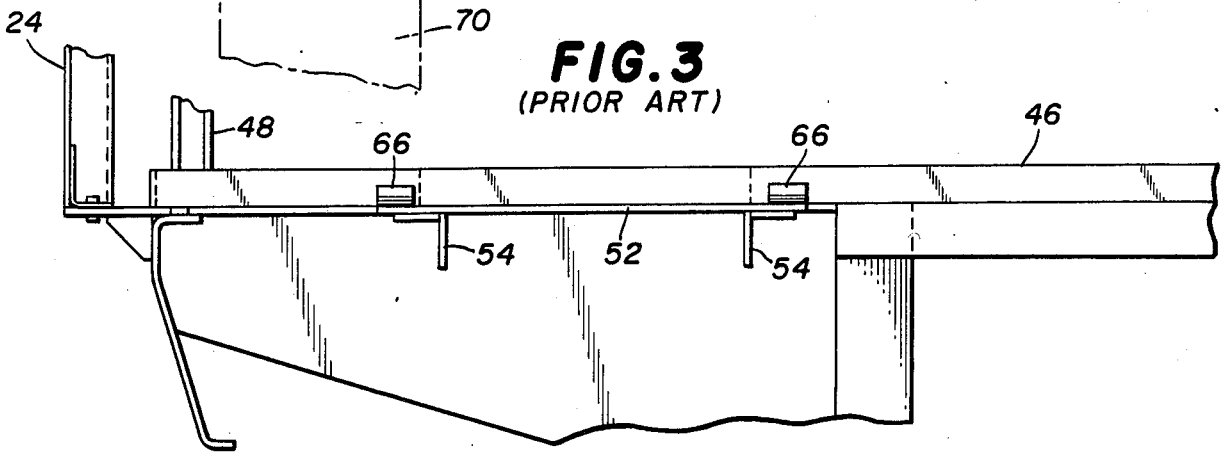
FIG. 3 (PRIOR ART)
FIG. 3 is an end view of the car floor shown in FIG. 2.
Figure 4:
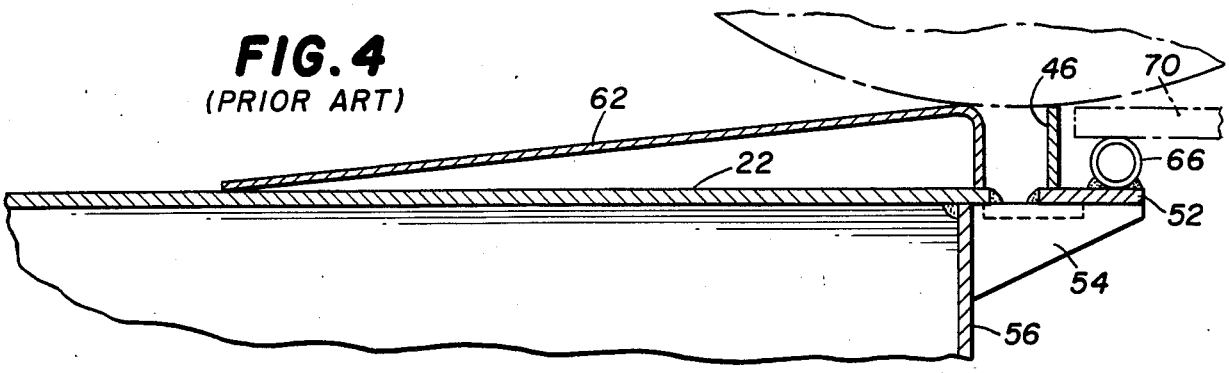
FIG. 4 (PRIOR ART)
FIG. 4 is a sectional view taken along the line 4—4 of FIG. 2.

The front run or portion of track 46, which is lateral of the car, is mounted on plates 52 supported by gussets 54 joined to the end sill 56 of the car (FIGS. 2 and 4). The side legs 46A of the track are joined to either the top of floor 22 or the side sills by suitable supports.

Mounted on floor 22 is a pair of tie down channels 60 used to secure vehicles in place. Also mounted on floor 22 is a pair of spaced apart inclined plates or ramps 62 which extend upwardly from the floor to the height of track 46 so as to permit vehicle tires to pass over the track without being unduly locally deformed.

Each of the plates 52 has a pair of spaced apart stub tubes 66 mounted on the top thereof to removably receive the connecting pins of a conventional bridge plate 70 which extends between the adjoining ends of two railroad cars.

So far the description of the drawings has been essentially limited to FIGS. 1 to 4 which illustrate a prior art track arrangement for guiding the bottom ends of the door assemblies. A problem of considerable concern with the prior art guide track for the door is that the track projects above the car floor about 1.5 to 2 inches. As a result, when a vehicle traveling at a considerable speed runs over the track the vehicle can bounce high enough for the vehicle roof to hit the bottom of deck 30 and damage the vehicle roof. Reduced vehicle drive-in clearance because of the track height, plus a difference in elevation of a lower deck with respect to another higher deck, can prevent circus loading. Thus, the prior art guide track arrangement has significant deficiencies.

The prior art guide track shortcomings are overcome by the two specific embodiments of the invention illustrated in FIGS. 5 to 13.

Figure 5:
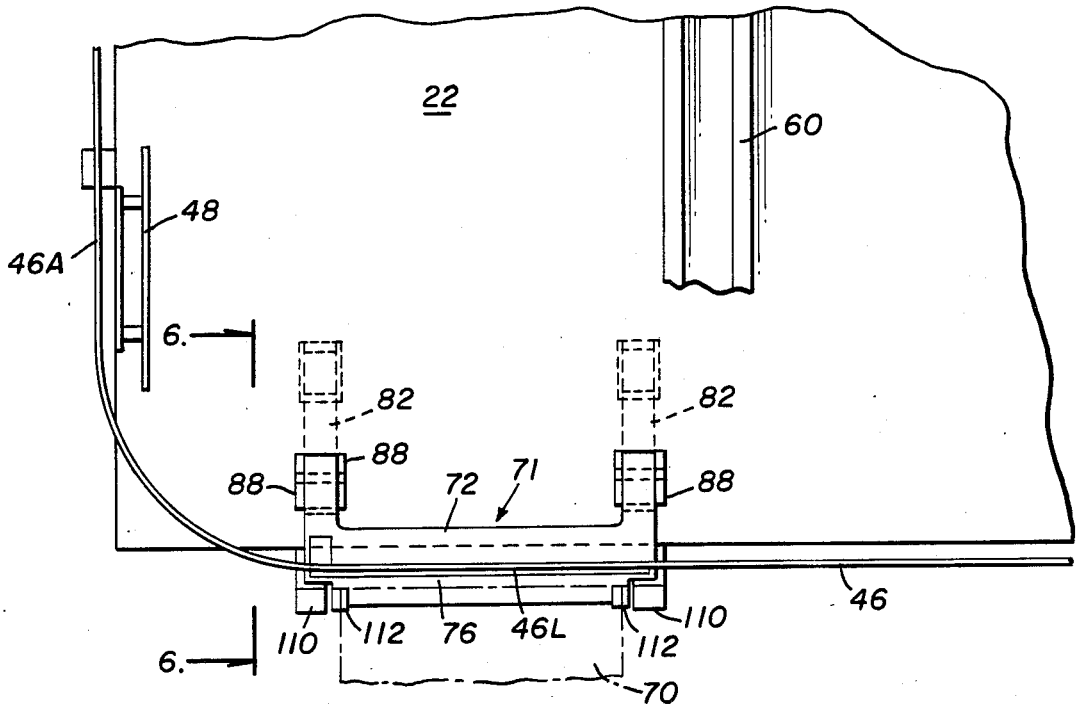
FIG. 5 is a plan view of the end portion of the floor of a car like that shown in FIGS. 1 to 4 but with two retractable track sections (only one being illustrated) according to a first embodiment of the invention.
Figure 6:
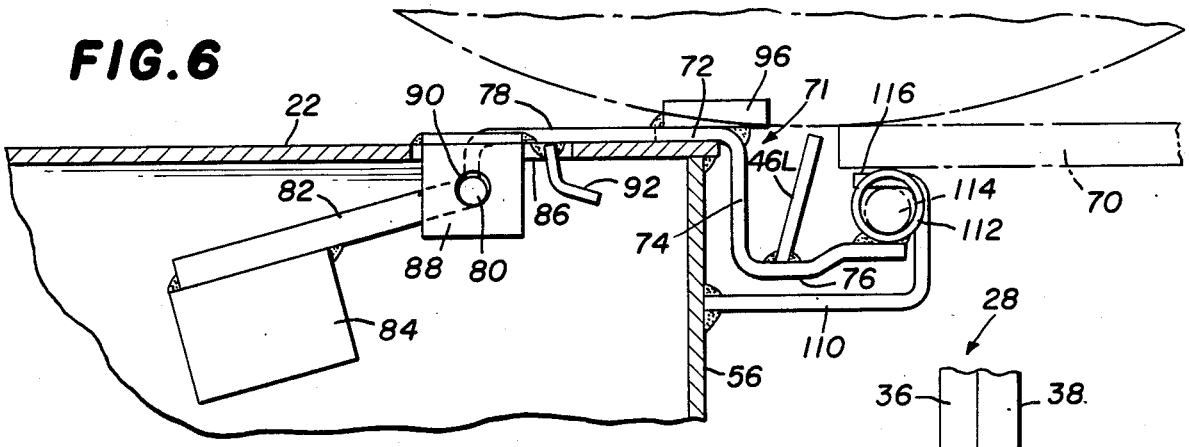
FIG. 6 is a sectional view taken along the line 6—6 of FIG. 5 with the retractable track section in down or retracted position.

The first embodiment of the invention is illustrated in FIGS. 5 to 7. In this embodiment, the front run i.e. the track portion lateral to the car, of guide track 46 is provided with retractable sections 46L which can be manually lowered so as to be no higher than the car floor when a bridge plate is put in position to load or unload the railroad car. When the bridge plate is removed, the retractable sections 46L return automatically by means of a counterweight to their up or raised position so that the door assemblies can be rolled into position to close the end of the railroad car. Although FIGS. 5 to 7 illustrate only a single retractable track section 46L it is to be understood that the car is provided with two track sections 46L which are spaced apart a sufficient distance to permit vehicles of different tread width to roll over only the retracted track sections and not over sections of the track 46 which remain fixed in place.

Substantially Z-shaped member 71 has an upper horizontal flange 72, a vertical web 74 and a lower horizontal flange 76. A pair of spaced apart arms 78 extend outwardly from upper flange 72. The outer end of each arm 78 is bent downwardly and joined to a pin 80. One end of a bar 82 is also joined to each pin 80. A counterweight 84 is connected to the other end of each bar 82.

A pair of spaced apart holes 86 are cut in car floor 22 to receive the arms 78,82. A pair of downwardly extending spaced apart flanges 88 are connected to the floor 22 adjacent the opposing sides of each hole 86. Each flange 88 contains a hole 90 which loosely receives an end of pin 80 thereby mounting the pin for free pivotal movement. A finger 92 is welded to the bottom of arm 78 at a position such that it projects downwardly through hole 86 and beneath the car floor 22. Finger 92 functions as a vertical upward travel stop for arm 78 as shown in FIG. 7.

Track section 46L is welded at the bottom edge to the top of flange 76 (FIGS. 6 and 7). This track section is positioned on the flange 76 such that when the counterweight 84 is permitted to apply its downward force without opposition, the track section is moved upwardly into alignment with adjacent portions of track 46 (FIGS. 5 and 7). At this point further upward movement is prevented by finger 92 abutting the car floor 22. With the track sections 46L in alignment with the track 46 the door assemblies can be moved from their stored position to their railroad car end closing position on the front run of track 46, which includes the track sections 46L.

When in their car closing position, the door assemblies prevent the track sections 46L from moving downwardly by a self-operating locking mechanism. A stop bar 96 is mounted on top of flange 72 with the end of the bar terminating above block 98 mounted on leg 40. Downward movement of the track section 46L is prevented when the door assemblies are closed because bar 96 hits block 98 and prevents such movement. However, when the door assemblies are in stowed position and the railroad car end is open, the bar 96 is not obstructed and the track section 46L can be moved down manually.

Movement of the door assemblies from stowed position to railroad car end closing position when the track sections 46L are in retracted position is prevented by the end of stop bar 96 which would be struck by the lower end of leg 40 (FIG. 7). Only when the track section 46L is in raised position does the end of stop bar 96 move out of the way enough for leg 40 to travel by along the track. A worker handling the door will thus be compelled to determine if an obstruction prevents the track section 46L from returning to raised position and to then take steps to remove the obstruction so that the door assembly can be closed. The described mechanism and operation constitutes an additional security feature in that the door when closed will always have the legs 40,42 on each side of the track section 46L.

A pair of spaced apart bridge plate retainers 110 is welded to the end sill 56. Mounted on the forward edge, and at the side edges, of flange 76 is a pair of spaced apart stub tubes 112 which removably receive the mounting pins 114 of a conventional bridge plate. After the door assemblies are rolled from car end closing position into stowed position, the track section 46L is pushed down manually as far as it will go. This downward movement is limited by flange 72 hitting the car floor 22. At that point the stub tubes 112 are located so as to have the holes therein below the retaining fingers 116. The bridge plate pins are then inserted through the holes in the stub tubes 112 and out their ends into extended position beneath finger 116. With the bridge plate in mounted position, the track sections 46L are held in down position automatically. The top of the retracted track sections 46L are at essentially the same height as the car floor 22 so they do not interfere with movement of vehicles onto or off of the railroad car. No bump is present to cause the vehicles to bounce and possibly have the vehicle roof hit deck 30. Apart from the elimination of the bouncing problem, the described apparatus increases the loading height between floor 22 and deck 30 about 1.5 to 2 inches thereby providing important load clearance.

A second embodiment of retractable track section apparatus is illustrated by FIGS. 8 to 13. This embodiment utilizes springs instead of lever arms to return the retractable track sections to up position.

Angle member 130 is welded to the face of end sill 56 beneath each predetermined vehicle tire path on the car floor 22. It should be understood that two tire paths are provided for at each railroad car end to accommodate four wheel vehicles. The two tire paths constitute the tread width of the vehicles. Since the vehicles carried by the railroad car vary in tread width the retractable track sections 46S (and also the sections 46R previously discussed) are made long enough to accommodate the tread widths of all the vehicles without special arrangements.

The top horizontal web 132 of angle 130 is provided with two spaced apart holes 134. Each hole slidably receives a vertically positioned tubular member 136 on the top of which is mounted a horizontal plate 138. Retractable track section 46S is welded vertically to the top of plate 138.

The lower portion of tubular member 136 contains a vertical axial opening 142 (FIGS. 11 and 12) which is wide enough to receive the end of spring support arm 140 which is welded to angle 130. Coil spring 144 in tubular member 136 presses against plate 138 and arm 140.

The lower end of tubular member 136 is slidably positioned in a hole 146 in arm 148 horizontally joined to angle 130. A foot plate 150 is welded to the lower end of tubular member 136 to keep the tubular member from being pushed higher by the spring.

Extending upwardly from the rear of plate 138 is a hook member 156 having a recess 157. Hook member 156 is located on plate 138, advisably toward the outer edge of this plate so as to be at the outer edge of the vehicle track whereby tires do not run over it. Hook member 156 can have any lateral width but will usually be about one inch wide. Stop lug 158 is mounted on leg 40 of a door assembly (FIG. 11). When the door assembly is in position to close the end of the railroad car the end of lug 158 extends into recess 157 in hook 156 thus preventing downward movement of track section 46S. The described locking mechanism, however, permits free rolling movement of the door assembly from the car end closing position to the position in which the door assembly is stowed along the car side wall.

Figure 13:
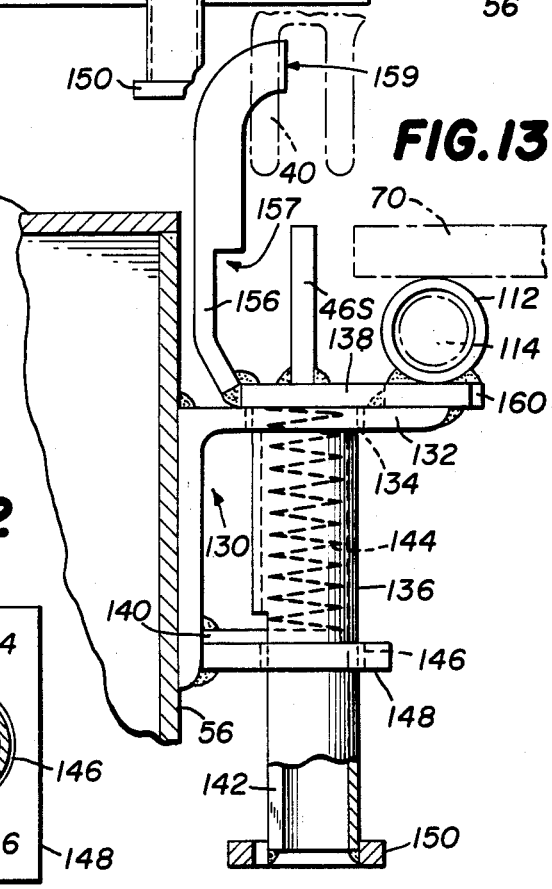
FIG. 13 is similar to FIG. 11 but it shows the retractable track section in down or retracted position.

Each door assembly is prevented from being moved from stowed position to closed position when the track sections 46S are in retracted position by means of the top end 159 of each hook member 156. As seen in FIG. 13, when the track section 46S is in retracted position the top end 159 will block movement of the door assembly because the leg 40 will hit end 159. Only when track section 46S is in raised position (FIG. 11) is the end 159 raised enough to avoid obstructing movement of leg 40 along the track section. The described mechanism constitutes an additional security feature in that when the door assemblies are closed the track sections 46S will keep the bottom of the door assemblies in proper position and prevent them from being pried loose.

Mounted on the front edge and at each of the side edges of flange 132 is a shim 160 which supports a stub tube 112. The plate 138 is shorter than the distance between the two stub tubes 112 and shims 160 thereby permitting plate 138 to move down into contact with flange 132 when the springs 144 are compressed by manual force applied to plate 138 or track 46S (FIGS. 11 and 13). With plate 138 in contact with plate 132, a conventional bridge plate 70 can be mounted in place by inserting the usual bridge plate mounting pins 114 in stub tubes 112. After the bridge plate 70 is mounted in place, the track 46S is prevented from moving up because the bridge plate end is mounted above plate 138. In this position, the top of hook 156 extends above floor 22 a short distance but it does not interfere with movement of vehicle tires since it is at the outer edge of the vehicle track. Only after the bridge plate is removed can the compressed springs 144 force plate 138, and track 46S, upwardly into raised position in alignment with the adjacent portions of guide track 46. It will be seen in FIG. 13 that when the track section 46S is down the track section top surface is lower than car floor 22, thus providing the advantages previously discussed in connection with the first embodiment of the invention.

The foregoing detailed description has been given for clearness of understanding only, and no unnecessary limitations should be understood therefrom, as modifications will be obvious to those skilled in the art.

What is claimed is:

1. A railroad car for transporting four-wheel vehicles such as automobiles and trucks, comprising:

a floor and two side walls defining an interior space and terminating in an opening at each end;

an end closure at each end of the car adapted to be displaced between a closed position overlying the end opening and an opened position which provides access to the entire end of the car;

an elongated closure support member at each end of the car disposed within the car interior in a horizontal plane;

the closure support member having a front run lateral to the car and a side run along each car side wall;

the closure comprising a pair of door assemblies;

each door assembly having a forward vertical end and a rear vertical end;

means vertically suspending the door assemblies from the closure support member so that the door assmblies are movable horizontally toward each other into closed position to close the car end with forward ends of the door assemblies in abutting position to each other in the middle of the closure support member front run, and away from each other into position with each door assembly supported on a closure support member side run;

a guide track, for the door assemblies, disposed within the car interior in a horizontal plane and mounted to the car floor and extending upwardly therefrom;

the guide track having a front run lateral to the car and a side run along each car side wall;

guide means carried by the bottom of the door assemblies engaging the guide track to guide the door assembliess along the track when they are moved to open and close the car end;

the guide track front run having two spaced apart retractable track sections movable up and down from an up position wherein the track sections project above the floor level to a down position wherein the track sections are at a height not above the floor level;

each of the retractable track sections in said down position being positioned to be rolled over by the wheels on one side of the four-wheel vehicles transported by the railroad car;

means forcibly maintaining the retractable track sections in said up position when the door assemblies are closed;

locking means preventing the track sections from moving down and out of engagement with the guide means carried by the bottom of the door assemblies, when the door assemblies are closed;

bridge plate support means mounted on the car adjoining each retractable track section; and means maintaining a track section in said down position when a bridge plate is engaged with the adjoining bridge plate support means.

2. A railroad car according to claim 1 in which the means forcibly maintaining the retractable track sections in said up position is a spring means.

3. A railroad car according to claim 1 in which the means forcibly maintaining the retractable track sections in said up position is a counterweighted lever.

4. A railroad car according to claim 1 in which the locking means disengages when the door assembly guide means is out of engagement with the track section.

5. A railroad car according to claim 1 including means blocking movement of the door assembly into railroad car end closing position when the track section is in said down position but permitting such movement when the track section is in said up position.

6. A railroad car for transporting four-wheel vehicles such as automobiles and trucks, comprising:

a floor and two side walls defining an interior space and terminating in an opening at each end;

an end closure at each end of the car adapted to be displaced between a closed position overlying the end opening and an opened position which provides access to the entire end of the car;

an elonagated closure support member at each end of the car disposed within the car interior in a horizontal plane;

the closure support member having a front run lateral to the car and a side run along each car side wall;

the closure comprising a pair of door assemblies;

each door assembly having a forward vertical end and a rear vertical end;

means vertically suspending the door assemblies from the closure support member so that the door assemblies are movable horizontally toward each other into closed position to close the car end with the forward ends of the door assemblies in abutting position to each other in the middle of the closure support member front run, and away from each other into open position with each door assembly supported on a closure support member side run;

a guide track, for the door assemblies, disposed within the car interior in a horizontal plane and mounted to the car floor and extending upwardly therefrom;

the guide track having a front run lateral to the car and a side run along each car side wall;

guide means carried by the bottom of the door assemblies engaging the guide track to guide the door assemblies along the track when they are moved to open and close the car end;

the guide track front run having two spaced apart retractable track sections movable up and down from an up position wherein the track sections project above the floor level to a down position wherein the track sections are at a height not above the floor level;

bridge plate support means mounted on the car adjoining each retractable track section;

means maintaining a track section in said down position when a bridge plate is engaged with the adjoining bridge plate support means;

each of the retractable track sections in said down position being positioned to be rolled over by the wheels on one side of four-wheel vehicles transported by the railroad car; and means forcibly maintaining the retractable track sections in said up position when the door assemblies are closed.

7. A railroad car according to claim 6 including locking means preventing the track sections from moving down and out of engagement with the guide means carried by the bottom of the door assemblies when the door assemblies, are closed.

8. A railroad car according to claim 7 in which the locking means disengages when the door assembly guide means is out of engagement with the track section.

9. A railroad car according to claim 6 including means blocking movement of the door assembly into railroad car end closing position when the track section is in said down position but Permitting such movement when the track section is in said up position.

10. A railroad car according to claim 6 in which the means forcibly maintaining the retractable track sections in said up position is a spring means.

11. A railroad car according to claim 6 in which the means forcibly maintaining the retractable track sections in said up position is a counterweighted lever.

12. A railroad car for transporting four-wheel vehicles such as automobiles and trucks, comprising:

a floor and two side walls defining an interior space and terminating in an opening at each end;

an end closure at each of the car adapted to be displaced between a closed position overlying the end opening and an opened position which provides access to the entire end of the car;

an elongated closure support member at each end of the car disposed within the car interior in a horizontal plane;

the closure support member having a front run lateral to the car and a side run along each car side wall;

the closure comprising a pair of door assemblies;

each door assembly having a forward vertical end and a rear vertical end;

means vertically suspending the door assemblies from the closure support member so that the door assemblies are movable horizontally toward each other into closed position to close the car end with the forward ends of the door assemblies in abutting position to each other in the middle of the closure support member front run, and away from each other into open position with each door assembly supported on a closure support member side run;

a guide track, for the door assemblies, disposed within the car interior in a horizontal plane and mounted to the car floor and extending upwardly therefrom;

the guide track having a front run lateral to the car and a side run along each car side wall;

guide means carried by the bottom of the door assemblies engaging the guide track to guide the door assemblies along the track when they are moved to open and close the car end;

the guide track front run having two spaced apart retractable track sections movable up and down from an up position wherein the track sections project above the floor level to a down position wherein the track sections are at a height not above the floor level;

bridge plate support means mounted on the car adjoining each retractable track section;

means maintaining a track section in said down position when a bridge plate is engaged with the adjoining bridge plate support means; and each of the retractable track sections in said down position being positioned to be rolled over by the wheels on one side of four-wheel vehicles transported by the railroad car.

13. A railroad car according to claim 12 including:

locking means preventing the track sections from moving down and out of engagement with the guide means carried by the bottom of the door assemblies, when the door assemblies are closed.

14. A railroad car according to claim 13 in which the locking means disengages when the door assembly guide means is out of engagement with the track section.

15. A railroad car according to claim 12 including means blocking movement of the door assembly into railroad car end closing position when the track section in sAid down position but permitting such movement when the track section is in said up position.

16. A railroad car for transporting four-wheel vehicles such as automobiles and trucks, comprising:

a floor and two side walls defining an interior space and terminating in an opening at each end;

an end closure at each end of the car adapted to be displaced between a closed position overlying the end opening and an opened position which provides access to the entire end of the car;

an elongated closure support member at each end of the car disposed within the car interior in a horizontal plane;

the closure support member having a front run lateral to the car and a side run along each car side wall;

the closure comprising a pair of door assemblies;

each door assembly having a forward vertical end and a rear vertical end;

each door assembly comprising a plurality of vertical panels having a bottom edge, and means joined to the bottom edge of each panel slidably engaging the track;

means vertically suspending the door assemblies from the closure support member so that the door assemblies are movable horizontally toward each other into closed position to close the car end with the forward ends of the door assemblies in abutting position to each other in the middle of the closure support member front run, and away from each other into open position with each door assembly supported on a closure support member side run;

a guide track, for the door assemblies, disposed within the car interior in a horizontal plane and mounted to the car floor and extending upwardly therefrom;

the guide track having a front run lateral to the car and a side run along each car side wall;

guide means carried by the bottom of the door assemblies engaging the guide track to guide the door assemblies along the track when they are moved to open and close the car end;

the guide track front run having two spaced apart retractable track sections movable up and down from an up position wherein the track sections project above the floor level to a down position wherein the track sections are at a height not above the floor level;

each of the retractable track sections in said down position being positioned to be rolled over by the wheels on one side of the four-wheel vehicles transported by the railroad car;

means forcibly maintaining the retractable track sections in said up position when the door assemblies are closed;

locking means preventing the track sections from moving down and out of engagement with the guide means carried by the bottom of the door assemblies, when the door assemblies are closed;

bridge plate support means mounted on the car adjoining each retractable track section; and means maintaining a track section in said down position when a bridge plate is engaged with the adjoining bridge plate support means.

* * * * *

UNITED STATES PATENT AND TRADEMARK OFFICE

CERTIFICATE OF CORRECTION

PATENT NO. : 4,677,918

DATED : July 7, 1987

INVENTOR(S) : William R. Baker et al

It is certified that error appears in the above-identified patent and that said Letters Patent is hereby corrected as shown below:

Column 7, line 47, after "with" insert -- the --; line 61, change "assembliess" to -- assemblies --; column 9, line 29, change "Permitting" to -- permitting --; column 10, line 32, change "sAid" to -- said --.

Signed and Sealed this

Twenty-seventh Day of October, 1987

*Attest:*

*Attesting Officer*

DONALD J. QUIGG

*Commissioner of Patents and Trademarks*